US010408070B2

(12) United States Patent
Mahias et al.

(10) Patent No.: US 10,408,070 B2
(45) Date of Patent: Sep. 10, 2019

(54) TURBINE ENGINE GUIDE VANE

(71) Applicant: Safran Aircraft Engines, Paris (FR)

(72) Inventors: Stephane Roger Mahias, Montrouge (FR); Baptiste Batonnet, Sezanne (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 527 days.

(21) Appl. No.: 15/347,704

(22) Filed: Nov. 9, 2016

(65) Prior Publication Data

US 2017/0298746 A1 Oct. 19, 2017

(30) Foreign Application Priority Data

Nov. 10, 2015 (FR) ..... 15 60771

(51) Int. Cl.

| | |
|---|---|
| ***F01D 9/02*** | (2006.01) |
| ***F01D 5/14*** | (2006.01) |
| ***F01D 5/16*** | (2006.01) |
| ***F01D 25/04*** | (2006.01) |

(52) U.S. Cl.

CPC ..... *F01D 9/02* (2013.01); *F01D 5/141* (2013.01); *F01D 5/16* (2013.01); *F01D 25/04* (2013.01); *F05D 2220/30* (2013.01); *F05D 2250/183* (2013.01); *F05D 2250/184* (2013.01); *F05D 2250/185* (2013.01); *F05D 2250/71* (2013.01); *F05D 2250/711* (2013.01); *F05D 2250/712* (2013.01); *F05D 2250/74* (2013.01); *F05D 2260/96* (2013.01)

(58) Field of Classification Search

CPC ... F01D 9/02; F01D 5/141; F01D 5/16; F01D 25/04; F01D 5/14; F05D 2220/30; F05D 2250/183; F05D 2250/184; F05D 2250/185; F05D 2250/71; F05D 2250/711; F05D 2250/712; F05D 2250/74; F05D 2260/96; F05D 2260/961

USPC ..... 415/119, 208.1

See application file for complete search history.

(56) References Cited

U.S. PATENT DOCUMENTS

| | | | | |
|---|---|---|---|---|
| 4,108,573 A * | 8/1978 | Wagner | F01D 5/141 416/236 A |
| 4,830,315 A * | 5/1989 | Presz, Jr. | B64C 21/10 114/102.29 |
| 5,988,982 A * | 11/1999 | Clauer | C21D 10/005 219/121.62 |
| 2007/0041841 A1 * | 2/2007 | Walter | F01D 5/141 416/223 R |

(Continued)

*Primary Examiner* — Jason D Shanske
*Assistant Examiner* — Sang K Kim
(74) *Attorney, Agent, or Firm* — Womble Bond Dickinson (US) LLP

(57) ABSTRACT

The present invention relates to a turbine engine guide (23) vane (25), with a height (H) extending between a vane root (26) and a vane tip (27) along a radial direction (Z), said vane (25) comprising a succession of five bulge portions along a tangential direction (Y) perpendicular to the radial direction (Z), this succession of bulge portions extending over the whole height (H) of the vane (25), and the convexity of the successive bulge portions being alternately in one direction and in the other. The vane (25) has the advantage of having an eigenfrequency for the first striped vibration mode which is different from the urging frequencies of said vane (25), during the operation of the turbine engine.

9 Claims, 11 Drawing Sheets

(56) References Cited

U.S. PATENT DOCUMENTS

| | | | | |
|---|---|---|---|---|
| 2013/0156592 | A1* | 6/2013 | Kray | F01D 5/141<br>416/229 A |
| 2013/0164488 | A1* | 6/2013 | Wood | F04D 29/324<br>428/80 |
| 2013/0205800 | A1* | 8/2013 | Ivakitch | F01D 9/042<br>60/805 |
| 2013/0266451 | A1* | 10/2013 | Pesteil | F01D 5/141<br>416/223 R |
| 2014/0248144 | A1* | 9/2014 | Cellier | F01D 5/141<br>415/208.1 |
| 2015/0192024 | A1* | 7/2015 | Jablonski | F01D 5/141<br>415/208.1 |
| 2015/0217851 | A1* | 8/2015 | Kelso | B64C 3/16<br>244/200 |

* cited by examiner

PRIOR ART

TURBINE ENGINE GUIDE VANE

GENERAL TECHNICAL FIELD

The present invention relates to a guide vane of a turbine engine which is made in order to limit coincidences between the eigenfrequency of the vane in the first stripe vibration mode and the vane urging frequencies, during the operation of the turbine engine.

STATE OF THE ART

Conventionally, bypass turbine engines extend along a main axis and comprise an air sleeve through which a gas flow penetrates into the turbine engine and in which the gas flow crosses a fan. Downstream from the fan, the gas flow separates into a primary gas flow flowing in a primary passage and a secondary gas flow flowing in a secondary passage.

In the primary passage, the primary flow crosses, from the upstream side to the downstream side, a low pressure compressor, a high pressure compressor, a combustion chamber, a high pressure turbine, a low pressure turbine, and a gas exhaust casing to which is connected an exhaust nozzle. In the secondary passage, the secondary flow crosses a fan guide vane, and then will be mixed with the primary flow at the exhaust nozzle.

Each compressor of the turbine engine comprises several stages, each stage being formed by a fixed vane assembly or stator or even guide vane, and a rotary vane assembly or rotor around the main axis of the turbine engine. The guide vane and the rotor of a compressor stage each comprise a plurality of vanes regularly distributed around the main axis of the turbine engine and radially extending relatively to this axis, inside the primary passage so as to be crossed by the primary flow.

When the turbine engine is operating, the vanes of a compressor guide vane vibrate because of the flow of the primary flow along said vanes.

Now, the vanes of the compressor rotor(s) which are adjacent to the guide vanes generate, because of their rotation around the main axis of the turbine engine, harmonic excitations which, when their frequency is too close to an eigenfrequency of the guide vanes causes too large vibration amplitudes of the guide vanes which may lead to their deterioration or even to their breakage.

Document FR 2 981 396 is known from the prior art, which describes a compressor vane of a turbine engine with a main radial orientation relatively to the main axis of the turbine engine, the vane including a radially internal root portion, a radially external tip portion, a radially intermediate portion, a tangentially bulge portion in one direction and at least one rectilinear portion at the root portion and/or at the tip portion. The tangentially bulge portion modifies the vibratory response of the vane to the vibration urges, and shifts away the eigenfrequencies of the vane from the urging frequencies, during the operation of the turbine engine.

However, such a vane geometry is not sufficiently efficient, when this is the first strip vibration mode or mode 2S1 (also called a "stripe mode"). Indeed, such a vane geometry does not give the possibility of sufficiently shifting away the eigenfrequencies of the vane with respect to the urging frequencies as regards the 2S1 mode.

FIG. 1 shows a guide vane of a turbine engine compressor according to the prior art, in the static condition (hatched) and in the deformed condition according to the 2S1 mode. It is observed on this figure that the nodal lines (In) of the 2S1 mode extend globally vertically over the whole height of the vane and consequently delimit stripes, whence its name of "stripe" mode.

PRESENTATION OF THE INVENTION

The object of the present invention is to propose a guide vane of a turbine engine which is made in such a way that the eigenfrequency of the vane for the first stripe mode is different from the urging frequencies of said vane, during the operation of the turbine engine.

More specifically, the object of the present invention is a turbine engine guide vane, with a height extending between a vane root and a vane tip along a radial direction, said vane comprising a succession of five bulge portions along a tangential direction perpendicular to the radial direction, this succession of bulge portions extending over the whole height of the vane, and the convexity of the successive bulge portions being alternately in one direction and in the other.

Preferentially, according to a first aspect, the vane being defined by a plurality of stacked sections along said radial direction, each section may be defined by a height along the radial direction from the root of the vane on the one hand and by a tangential coordinate positioning the center of gravity of said section along a tangential direction perpendicular to the radial direction, on the other hand, the curve of the stacking law which defines for each section, the tangential coordinate of the center of gravity of said section depending on the height of the latter, is a curve which is continuous from the root to the tip of the vane and which satisfies at least the following conditions:

the curve is located below a segment connecting the point of said curve which corresponds to the section at the root of the vane and the point of said curve which corresponds to the section at the tip of the vane, the curve is convex between the section height at the root of the vane and a first section height which is strictly greater than the section height at the root of the vane, the curve is concave between the first section height and a second section height which is strictly greater than the first section height, the curve is convex between the second section height and a third section height which is strictly greater than the second section height, the curve is concave between the third section height and a fourth section height which is strictly greater than the third section height, and the curve is convex between the fourth section height and the section height at the tip of the vane which is strictly smaller than the section height at the tip of the vane.

Advantageously, the tangential coordinate of the center of gravity is minimum for a fifth section height, said fifth section height being strictly greater than the second section height and strictly smaller than the third section height.

Advantageously, the fifth section height substantially corresponds to half the height of the vane.

Advantageously, the first, second, third and fourth section heights are distributed along the vane between the section height at the root of the vane and the section height at the tip of the vane so as to form successive vane segments of substantially equal height.

According to a first aspect of the invention, the curve of the stacking law of the sections of the vane:

is decreasing between the second section height and a fifth section height and increasing between the fifth section height and the third section height, said fifth section height being strictly greater than the second section height and strictly smaller than the third section height, and/or the curve is decreasing between the section height at the root of the vane and a sixth section height and increasing between the sixth section height and the first section height, said sixth section height being strictly greater than the section height at the root of the vane and strictly smaller than the first section height, and/or the curve is increasing between the first section height and a seventh section height and decreasing between the seventh section height and the second section height, said seventh section height being strictly greater than the first section height and strictly smaller than the second section height, and/or the curve is increasing between the third section height and an eighth section height and decreasing between the eighth section height and the fourth section height, said eighth section height being strictly greater than the third section height and strictly smaller than the fourth section height, and/or the curve is decreasing between the fourth section height and a ninth section height and increasing between the ninth section height and the section height at the tip of the vane, said ninth section height being strictly greater than the fourth section height and strictly smaller than the section height at the tip of the vane.

Preferentially, the points of the curve corresponding to the fifth, sixth, seventh, eighth and ninth heights respectively form a third, a first, a second, a fourth and a fifth apex of said curve, and the shift along the tangential direction of each of the apices of the curve relatively to a segment connecting, for each apex, the point of the curve positioned at half-distance between said apex and the preceding apex or when this is the first apex, at half-distance between said first apex and the point of the curve corresponding to the section at the root of the vane, and the point of the curve positioned at half-distance between said apex and the next apex or when this is the fifth apex, at half-distance between said fifth apex and the point of the curve corresponding to the section at the tip of the vane, is substantially equal to 10% of the height at the tip of the vane.

According to a second aspect of the invention, the representative curve of the stacking law of the sections of the vane is decreasing between the section height at the root of the vane and a fifth section height and increasing between the fifth section height and the section height at the tip of the vane, said fifth section height being strictly greater than the second section height and strictly smaller than the third section height.

The object of the invention is also a guide vane of a turbine engine comprising at least one vane as described earlier. The guide vane is for example a compressor, turbine or fan guide vane of a turbine engine.

The object of the invention is also a turbine engine comprising at least one guide vane as described earlier.

PRESENTATION OF THE FIGURES

Other features, objects and advantages of the present invention will become apparent upon reading the detailed description which follows, and with reference to the appended drawings given as nonlimiting examples and wherein.

Figure 2:
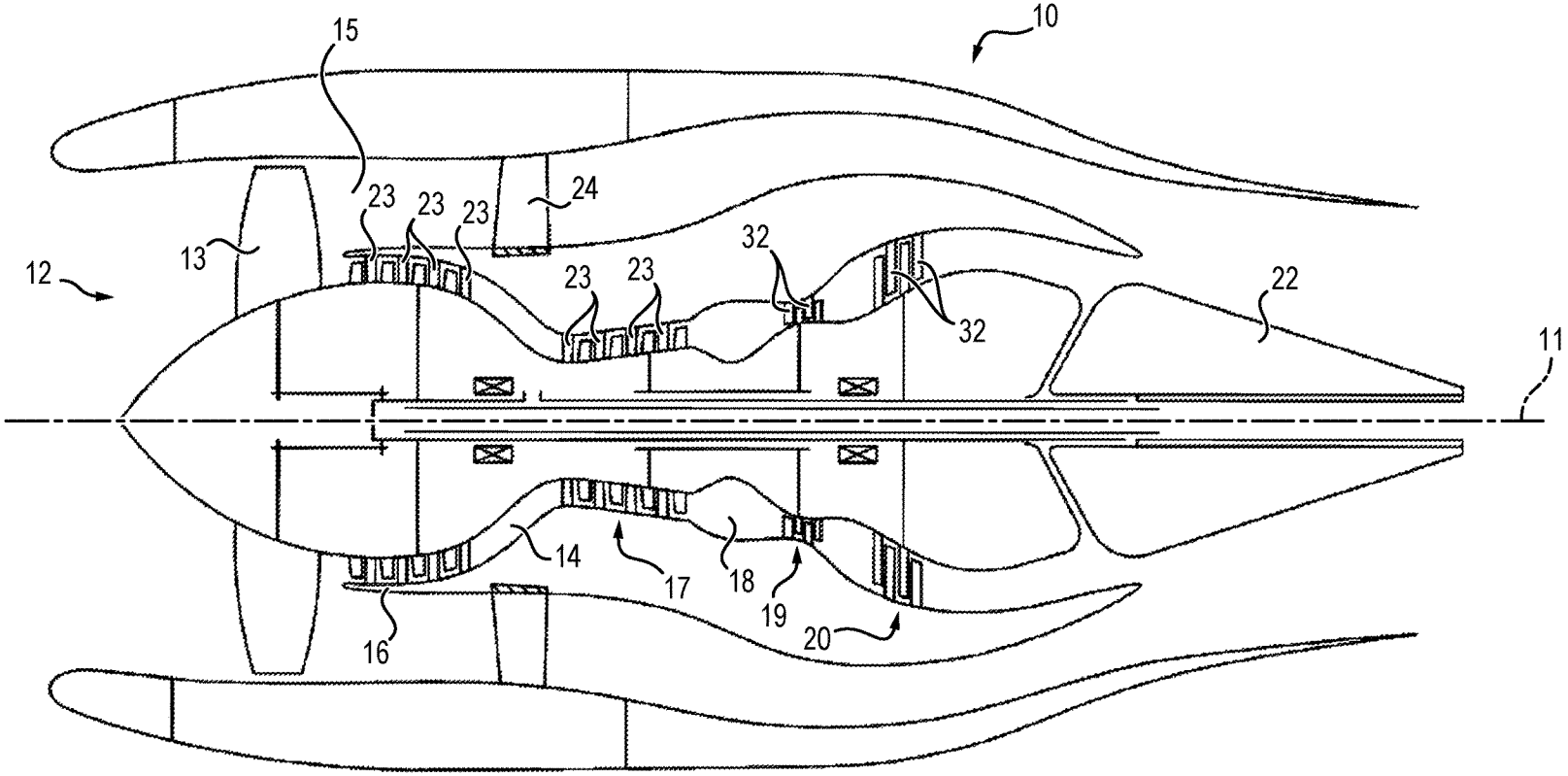
FIG. 2 is a schematic, longitudinal sectional view, of a turbine engine according to an embodiment of the invention.
Figure 3A:
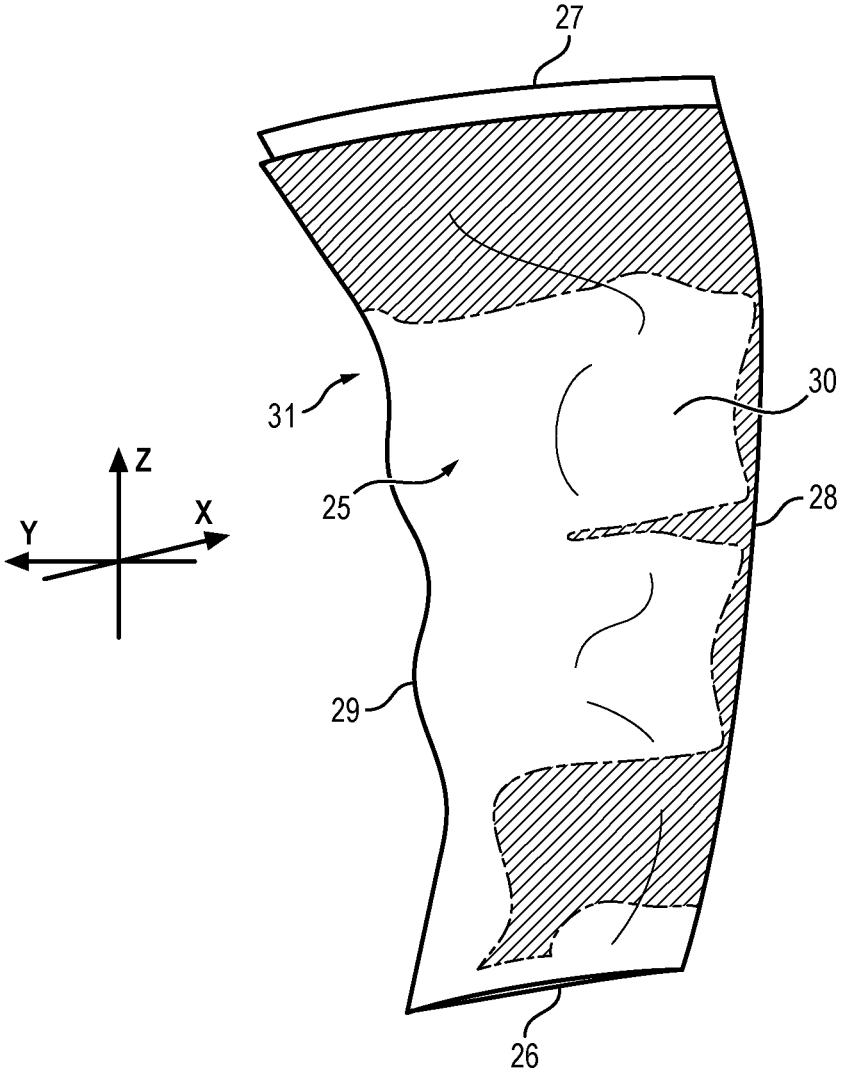
Figure 3B:
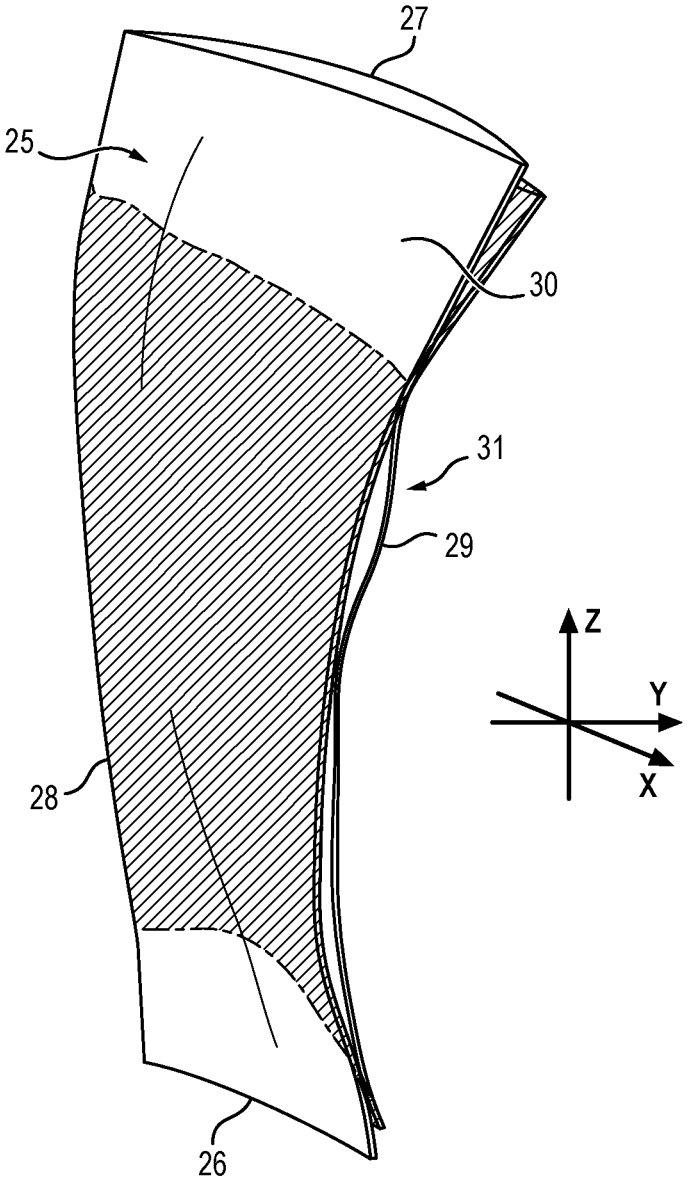
Figure 3C:
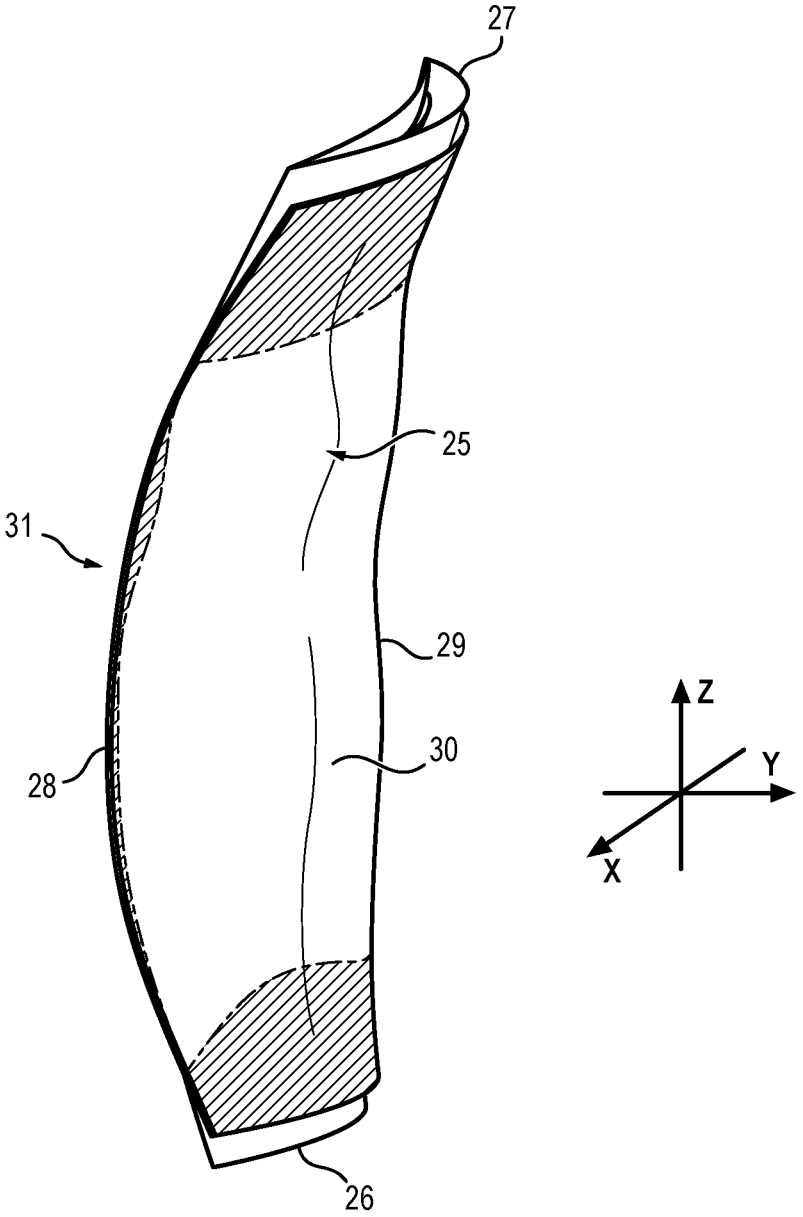
Figure 3D:
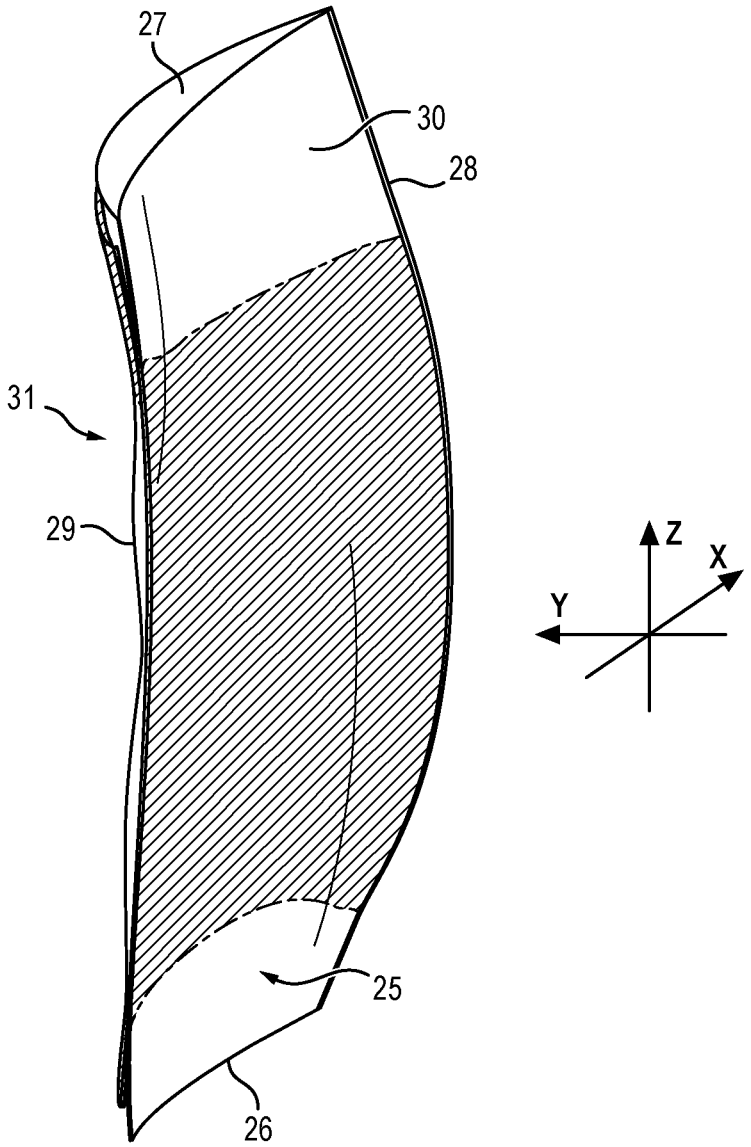
Figure 5B:
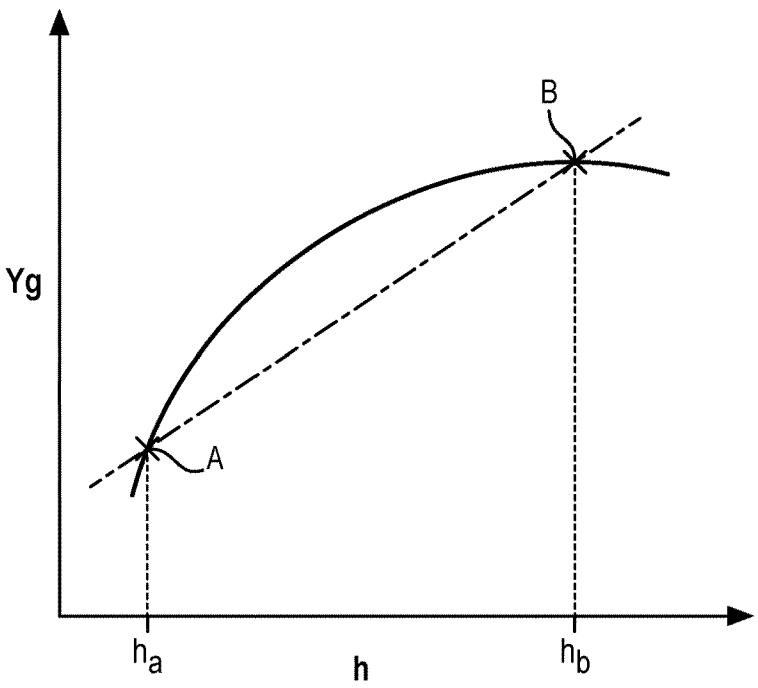
Figure 5A:
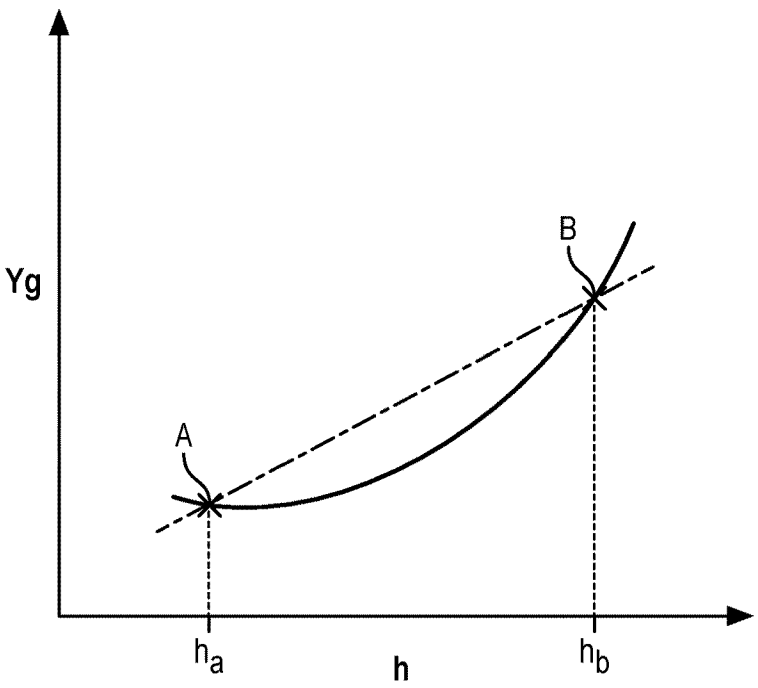

FIG. 3*a* is a perspective view of an exemplary guide vane for a compressor of a turbine engine illustrated in FIG. 2, according to a first aspect of the invention;

FIGS. 3*b* to 3*d* are each a perspective view of an exemplary guide vane for a compressor of a turbine engine illustrated in FIG. 2, according to a second aspect of the invention;

FIGS. 4*a* to 4*d* are graphs each illustrating a representative curve of the stacking law of a guide vane according to the invention;

FIGS. 5*a* and 5*b* are graphs respectively illustrating a so called convex curve and a so called concave curve.

DETAILED DESCRIPTION

FIG. 2 illustrates a bypass turbine engine 10 according to an embodiment of the invention. The turbine engine 10 extends along a main axis 11 and comprises an air sleeve 12 through which a gas flow penetrates into the turbine engine 10 and in which the gas flow crosses a fan 13. Downstream from the fan 13, the gas flow separates into a primary gas flow flowing in a primary passage 14 and a secondary gas flow flowing in a secondary passage 15.

In the primary passage 14, the primary flow crosses, from the upstream to the downstream side, a low pressure compressor 16, a high pressure compressor 17, a combustion chamber 18, a high pressure turbine 19, a low pressure turbine 20, and a gas exhaust casing to which is connected an exhaust nozzle 22. In the secondary passage 15, the secondary flow crosses a fixed vane assembly or a fan guide vane 24, and then which will mix with the primary flow at the exhaust nozzle 22.

Each compressor 16, 17 of the turbine engine 10 comprises several stages, each stage being formed by a fixed vane assembly or stator or even guide vane 23, and a rotary vane assembly or rotor around the main axis 11 of the turbine engine 10.

A compressor guide vane 23 comprises an internal shroud (not shown) extending around the main axis 11 of the turbine engine 10, an external shroud (not shown) coaxially made around the internal shroud and delimiting with the external shroud the primary passage 14 as well as a plurality of vanes radially extending with respect to the main axis 11 of the turbine engine 10 between the internal shroud and the external shroud.

FIG. 3*a* shows an exemplary vane 25 for a compressor guide vane 23 according to a first aspect of the invention. FIGS. 3*b* and 3*d* each show an exemplary vane 25 for a compressor guide vane 23 according to a second aspect of the invention. On each of these figures, an exemplary vane known from the prior art is also illustrated hatched.

As illustrated in FIGS. 3*a* to 3*d*, the vane 25 has a spatial reference system with three orthogonal directions X, Y, Z, the direction X being parallel to the main axis 11 of the turbine engine 10 and the direction Z being radial with respect to the main axis 11 of the turbine engine 10. In the subsequent description, the direction X will be called "axial direction X", the direction Y will be called "tangential direction Y" and the direction Z will be called "radial direction Z".

The vane 25 extends along the radial direction Z between a radially internal portion 26 called root of the vane, at which the vane 25 is attached to the internal shroud, and a radially external portion 27, called tip of the vane, at which the vane 25 is attached to the external shroud.

The vane 25 also comprises a leading edge 28 which is located axially upstream according to the flow direction of the gases relatively to the vane 25, and a trailing edge 29 which is located axially downstream according to the flow direction of the gases relatively to the vane 25.

The vane 25 further has a camber defining a globally convex face 30 called "suction side" on the one hand and a globally concave face 31 called "pressure side" on the other hand.

The vane 25 comprises a succession of five bulge portions along the tangential direction Y, this succession of bulge portions extending over the whole height H of the vane 25, and the convexity of the successive bulge portions being alternately in one direction and in the other.

In other words, the vane 25 has along the radial direction Z a succession of five bulge portions alternately extending towards the suction side 30 and towards the pressure side 31 of the vane 25, and not a unique portion bulged towards the suction side 30 as this is the case of known vanes.

This succession of bulge portions gives the possibility of shifting away the eigenfrequency of the vane 25 for the first stripe mode or 2S1 mode of the urging frequencies of said vane 25, during the operation of the turbine engine 10, thereby reducing the risks of having too large vibration amplitudes of the vane 25 which may lead to its deterioration or in the worst case to its breakage.

The vane 25 is defined by a plurality of sections stacked along the radial direction Z between the vane root 26 and the vane tip 27. Each section of the vane 25 is thereby defined by a coordinate h along the radial direction Z, which will be called the "section height h" in the subsequent description.

Each of these sections is also defined by an axial coordinate Xg along the axial direction X and by a tangential coordinate Yg along the tangential direction Y of the center of gravity G of said section.

The sections of the vane 25 are stacked according to a stacking law which defines the tangential coordinate Yg of the center of gravity G for each section of the vane 25 according to the height h of said section, between a height at the root of the vane $h_0$ and a height at the tip of the vane H. The stacking law allows definition of the profile of the vane 25.

FIGS. 4*a* to 4*d* show several examples of a curve $C_1$ to $C_4$ representative of the stacking law of the sections of a vane 25, and therefore of the profile of the vane 25, according to the invention, as well as a curve $C_0$ representative of a stacking law of the sections of a vane according to the prior art. The curve $C_1$ is representative of the stacking law of the sections of the vane 25 illustrated in FIG. 3*a*, while the curves $C_2$ to $C_4$ respectively are representative of the stacking law of the sections of the vanes 25 illustrated in FIGS. 3*b* to 3*d*. The vane for which the curve $C_0$ is representative of the stacking law of the sections is illustrated hatched in FIGS. 3*a* to 3*d*.

Preliminarily, it is defined that the representative curve of the stacking law of the sections of the vane 25 is convex between a section height $h_a$ and a section height $h_b$, with $h_a<h_b$, when the curve is located below a segment [AB] connecting the point A of said corresponding curve to the height section $h_a$ and the point B of said curve corresponding to the height section $h_b$. This definition is illustrated in FIG. 5*a*.

It is defined that the representative curve of the stacking law of the sections of the vane 25 is concave between a section height $h_a$ and a section height $h_b$, with $h_a<h_b$, when the curve is located above a segment [AB] connecting the point A of said corresponding curve to the height section $h_a$ and the point B of said corresponding curve to the height section $h_b$. This definition is illustrated in FIG. 5*b*.

The curves $C_1$ to $C_4$ are continuous from the root 26 to the tip 27 of the vane 25 and satisfy at least the following conditions:

the curve $C_1$ to $C_4$ is located below a segment [PT] connecting the point P of said curve corresponding to the section at the root 26 of the vane and the point T of said curve corresponding to the section at the tip 27 of the vane, the curve $C_1$ to $C_4$ is convex between the section height at the root of the vane $h_0$ and a first section height $h_1$ (excluded), said first section height $h_1$ being strictly greater than the section height at the root of the vane $h_0$, the curve $C_1$ to $C_4$ is concave between the first section height $h_1$ and a second section height $h_2$ (excluded), said second section height $h_2$ being strictly greater than the first section height $h_1$, the curve $C_1$ to $C_4$ is convex between the second section height $h_2$ and a third section height $h_3$ (excluded), said third section height $h_3$ being strictly greater than the second section height $h_2$, the curve $C_1$ to $C_4$ is concave between the third section height $h_3$ and a fourth section height $h_4$ (excluded), said fourth section height $h_4$ being strictly greater than the third section height $h_3$, and the curve $C_1$ to $C_4$ is convex between the fourth section height $h_4$ and the section height at the tip of the vane H (excluded), said fourth section height $h_4$ being strictly smaller than the section height at the tip of the vane H.

In this way, the vane 25 has along the radial direction Z a succession of five bulge portions alternately extending towards the suction side 30 and towards the pressure side 31 of the vane 25, thereby allowing shifting away of the eigenfrequency of the vane 25 for the 2S1 mode of the urging frequencies of said vane 25, during operation of the turbine engine 10, and reducing the risks of having too large vibration amplitudes of the vane 25 which may lead to its deterioration or in the worst case to its breakage.

According to a first aspect of the invention, the representative curve of the stacking law of the sections of the vane 25 further satisfies one or several of the following conditions:

the curve is decreasing between the second section height $h_2$ and a fifth section height $h_5$ (excluded) and increasing between the fifth section height $h_5$ and the third section height $h_3$ (excluded), said fifth section height $h_5$ being strictly greater than the second section height $h_2$ and strictly smaller than the third section height $h_3$, and/or the curve is decreasing between the section height at the root of the vane $h_0$ and a sixth section height $h_6$ (excluded) and increasing between the sixth section height $h_6$ and the first section height $h_1$ (excluded), said sixth section height $h_6$ being strictly greater than the section height at the root of the vane $h_0$ and strictly smaller than the first section height $h_1$, and/or the curve is increasing between the first section height $h_1$ and a seventh section height $h_7$ (excluded) and decreasing between the seventh section height $h_7$ and the second section height $h_2$ (excluded), said seventh section height $h_7$ being strictly greater than the first section height $h_1$ and strictly smaller than the second section height $h_2$, and/or the curve is increasing between the third section height $h_3$ and an eighth section height $h_8$ (excluded) and decreasing between the eighth section height $h_8$ and the fourth section height $h_4$ (excluded), said eighth section height $h_8$ being strictly greater than the third section height $h_3$ and strictly smaller than the fourth section height $h_4$, and/or the curve is decreasing between the fourth section height $h_4$ and a ninth section height $h_9$ (excluded) and increasing between the ninth section height $h_9$ and the section height at the tip of the vane H (excluded), said ninth section height $h_9$ being strictly greater than the fourth section height $h_4$ and strictly smaller than the section height at the tip of the vane H.

Figure 4A:
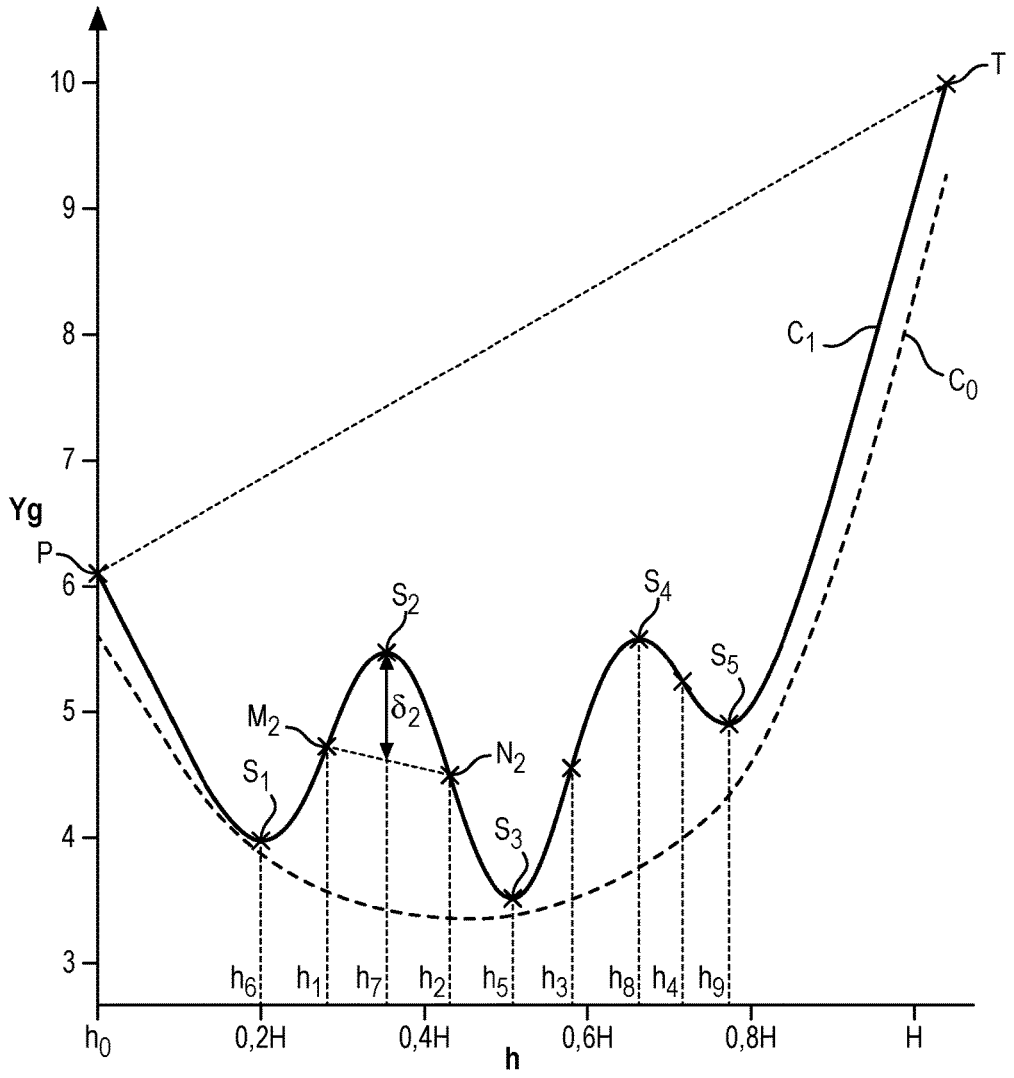

The curve $C_1$ illustrated in FIG. 4*a* satisfies all these conditions.

Figure 1:
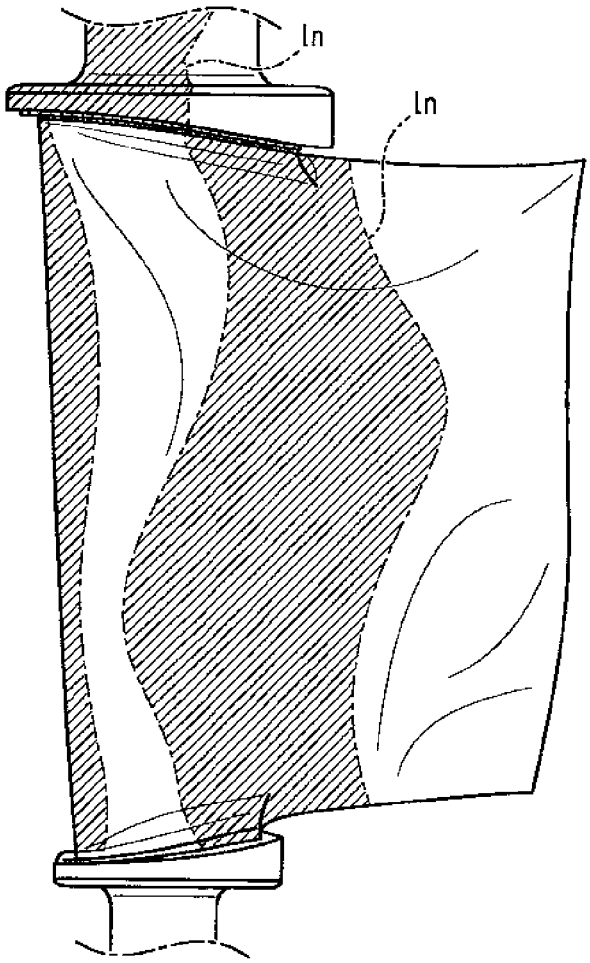
FIG. 1 (already described) is a perspective view of a vane of the prior art in a static condition and in a deformed condition according to the first stripe mode or 2S1 mode.

In this way, the bulge portions of the vane 25 form waves, the top of which is positioned perpendicularly to the nodal lines of the 2S1 mode of the vane 25, which extend radially (FIG. 1), which gives the possibility of shifting away in a particularly efficient way the eigenfrequency of the vane 25 for the 2S1 mode of the urging frequencies of said vane 25, during the operation of the turbine engine 10.

The points of the curve corresponding to the fifth, sixth, seventh, eighth and ninth heights $h_5$, $h_6$, $h_7$, $h_8$, $h_9$ respectively form the third, first, second, fourth and fifth apex $S_3$, $S_1$, $S_2$, $S_4$, $S_5$ of said curve $C_1$.

According to this first aspect of the invention, the shift $\delta_1$ along the tangential direction Y of each of the apices $h_6$, $h_7$, $h_5$, $h_8$, $h_9$ of the curve relatively to a segment $[M_iN_i]$ connecting, for each apex $S_1$, the point $M_i$ of the curve positioned at half-distance between said apex $S_i$ and the preceding apex $S_{i-1}$ or when this is the first apex $S_1$, at half-distance between said first apex $S_1$ and the point P corresponding to the section at the root of the vane 26, and the point $N_i$ of the curve positioned at half-distance between said apex $S_i$ and the next apex $S_{i+1}$ or when this is the fifth apex $S_5$, at half-distance between said fifth apex $S_5$ and the point T corresponding to the section at the tip of the vane 27, is substantially equal to 10% of the height at the tip of the vane H. By "substantially equal" is meant the fact that the shift $\delta_i$ is equal to 10% of the height at the tip of the vane H to within an error of 5%. For the sake of clarity, only the shift $\delta_2$ and the segment $[M_2N_2]$ relative to the second apex $S_2$ are illustrated in FIG. 4*a*.

Figure 4B:
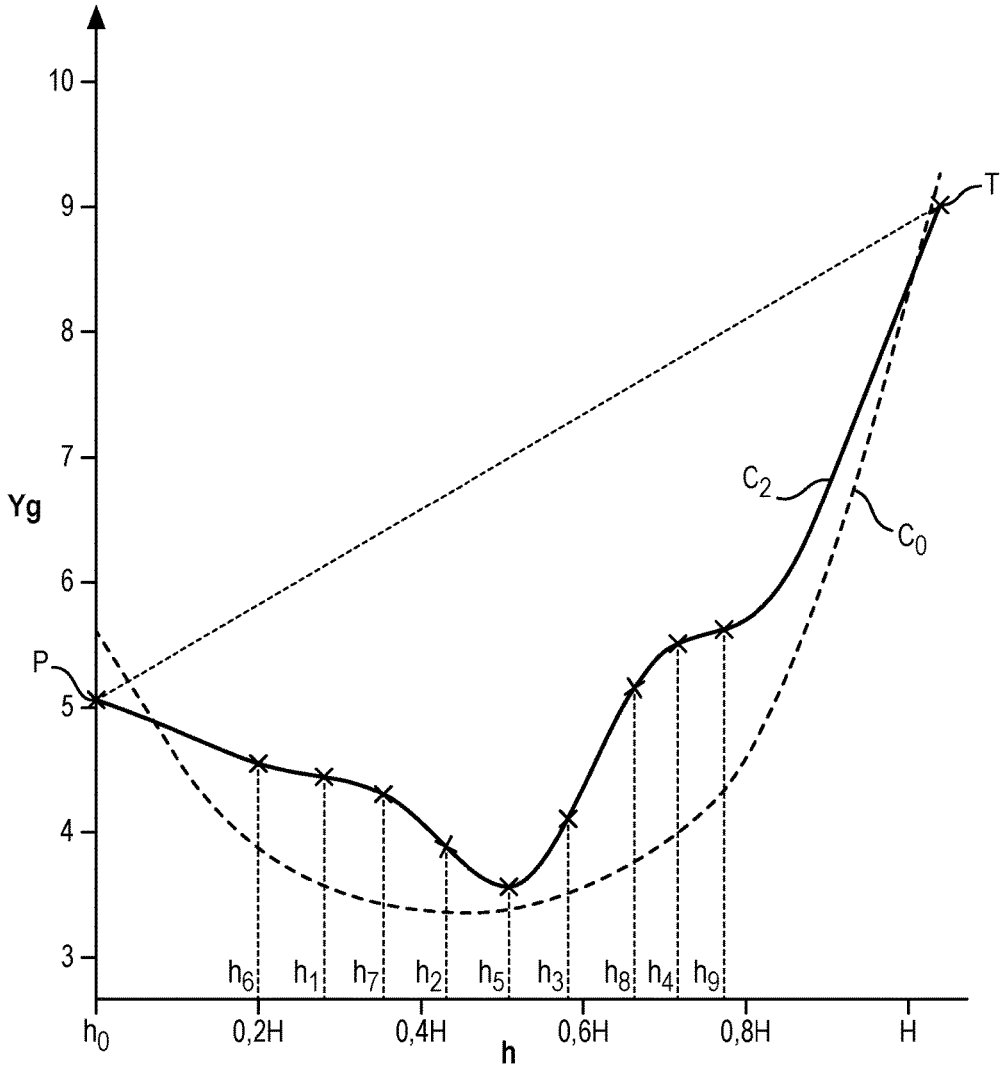
Figure 4C:
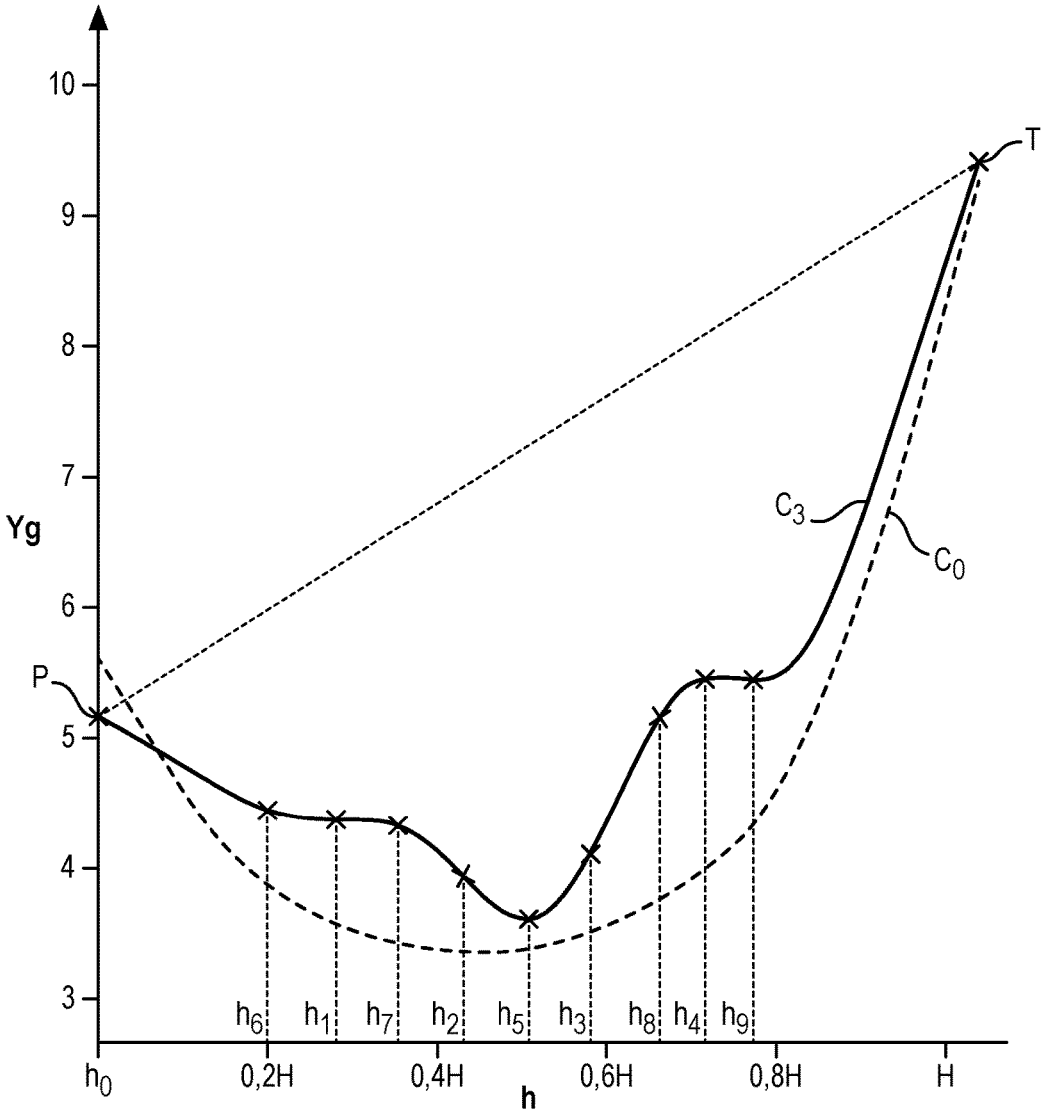
Figure 4D:
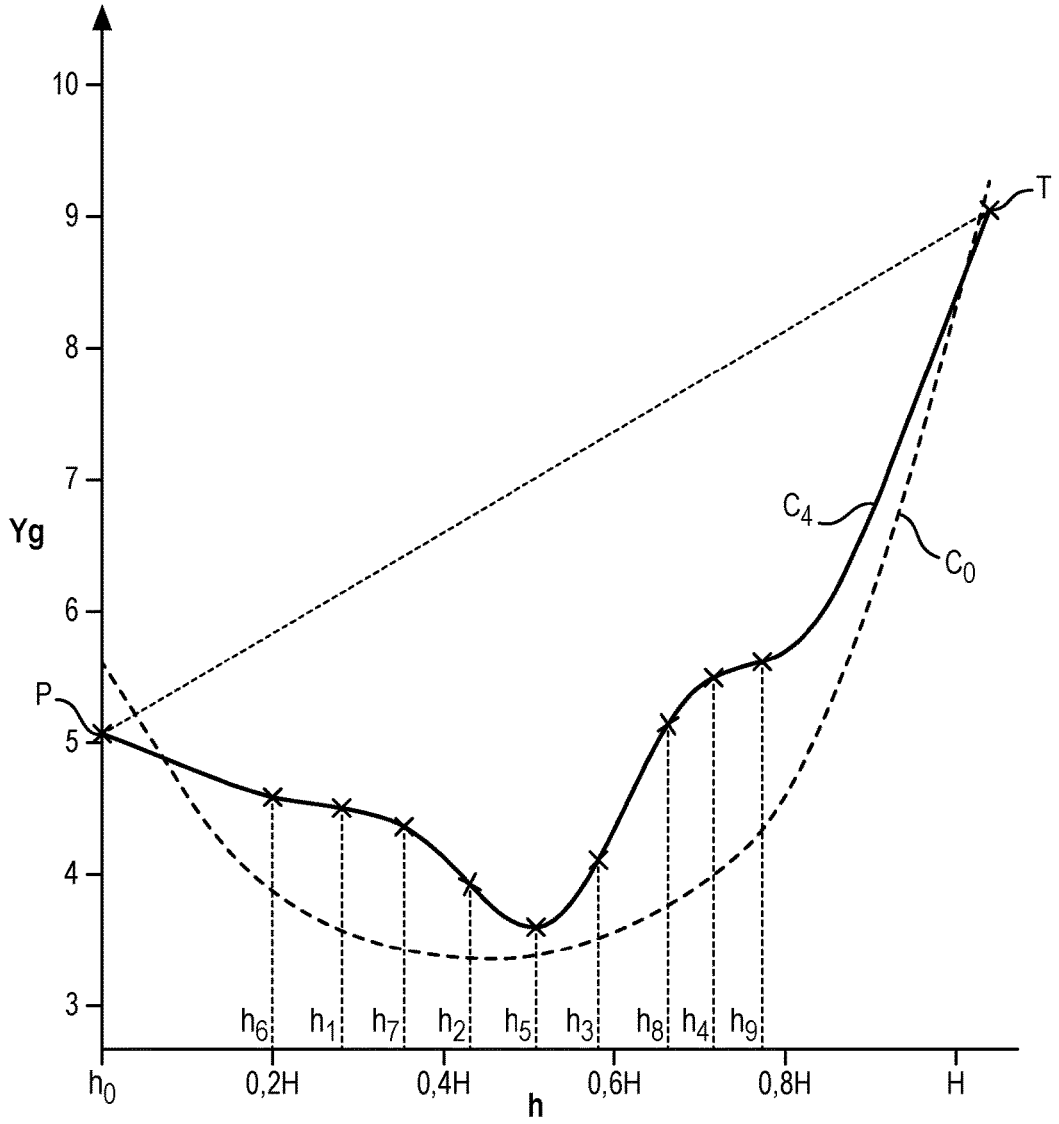

According to a second aspect of the invention, the representative curve of the stacking law of the sections of the vane 25 such as the curves $C_2$, $C_3$, $C_4$ illustrated in FIGS. 4*b* and 4*d*, satisfies the condition from which the curve is decreasing between the section height at the root of the vane $h_0$ and a fifth section height $h_5$ (excluded) and increasing between the fifth section height $h_5$ and the section height at the tip of the vane H (excluded), said fifth section height $h_5$ being strictly greater than the second section height $h_2$ and strictly smaller than the third section height $h_3$.

The bulge portions of the vane 25 according to this second aspect of the invention are particularly advantageous since they give the possibility of shifting away the eigenfrequency of the vane 25 for the 2S1 mode of urging frequencies of said vane 25, during the operation of the turbine engine 10, without however complicating the manufacturing of the vane 25.

It will be noted by comparing FIG. 3*a* to FIGS. 3*b* to 3*d* that the curvature of the bulge portions of the vane 25 are less marked according to this second aspect of the invention.

Preferably, the fifth section height $h_5$ substantially corresponds to the half the height of the vane 25. By "substantially at half-height" is meant that the fifth section height $h_5$ corresponds to the half the height of the vane 25 to within an error of 5%.

Preferably, the tangential coordinate Yg of the center of gravity G is a minimum for the fifth section height $h_5$.

Preferably, the first, second, third and fourth section heights $h_1$, $h_2$, $h_3$, and $h_4$ are distributed along the vane between the section height at the root of the vane $h_0$ and the section height at the tip of the vane H so as to form successive vane segments of substantially equal height. By "substantially equal" is meant that the successive vane segments are of equal height to within an error of 5%.

Preferably, the tangential coordinate Yg of the center of gravity G is smaller for the height section at the root of the vane $h_0$ than for the height section at the tip of the vane H.

One skilled in the art may for example obtain a curve $C_1$, $C_2$, $C_3$, $C_4$ by applying many well known pieces of software allowing interpolation of a curve from a finite number of points defined beforehand by the user and through the interpolated curve should pass. These predefined points may for example be the tangential coordinate Yg of the center of gravity G at the section height at the root of the vane $h_0$, at first, second third and fourth section heights $h_1$, $h_2$, $h_3$, $h_4$ and the section height at the tip of the vane H. The tangential coordinate Yg of the center of gravity G may further be predefined at the fifth section height $h_5$. One skilled in the art will be able by means of his/her general knowledge able to select the number of points to be predefined and define them so that the piece of software interpolates a curve satisfying the conditions described above. Alternatively, the curve $C_1$, $C_2$, $C_3$, $C_4$ may be interpolated by defining the tangential shift to be applied in several points of the representative curve $C_0$ of the stacking law of the sections of the vane according to the prior art.

It will be noted that the representative curves $C_1$, $C_2$, $C_3$, $C_4$ of the stacking law of the sections of the vane 25 according to the invention are defined in the description above by arbitrarily considering that the positive direction of the tangential direction Y extends from the suction side 30 to the pressure side 31 of the vane 25, the curves $C_1$, $C_2$, $C_3$, $C_4$ being located below the segment [PT]. It will therefore be understood that by considering oppositely that the positive direction of the tangential direction Y extends from the pressure side 31 to the suction side 30 of the vane 25, the curves $C_1$, $C_2$, $C_3$, $C_4$ will be located above the segment [PT] and the curvatures described above for the curves $C_1$, $C_2$, $C_3$, $C_4$ will be reversed. For example, the curves $C_1$, $C_2$, $C_3$, $C_4$ will be concave between the section height at the root of the vane $h_0$ and the first section height $h_1$ and no longer convex. Also, the tangential coordinate Yg of the center of gravity G will be maximum and no longer minimum for the fifth section height $h_5$ and the tangential coordinate Yg of the center of gravity G will be larger and no longer smaller for the height section at the root of the vane $h_0$ than for the height section at the tip of the vane H. One skilled in the art will of course be able to adapt the contents of the description depending on the relevant positive direction for the tangential direction Y.

The present invention is described below with reference to a guide vane 25 of a compressor 16, 17 of a turbine engine 10. However, the invention applies in the same way to guide vanes 32 of a turbine 19, 20 or to fan guide vanes 23, in so far that these vanes are confronted with the same technical problem because of the rotation of the rotor vanes of the turbine 19, 20 or of the vanes of the fan 13.

The invention claimed is:

1. A turbine engine guide vane, with a height extending between a vane root and a vane tip along a radial direction, said vane comprising a succession of five bulge portions along a tangential direction perpendicular to the radial direction, this succession of bulge portions extending over the whole height of the vane, and the convexity of the successive bulge portions being alternately in one direction and in the other, wherein, said vane being defined by a plurality of sections stacked along the radial direction, each section is defined by a height along the radial direction from the root of the vane and by a tangential coordinate of the center of gravity of said section along a tangential direction, a curve of the stacking law which defines for each section, the tangential coordinate of the center of gravity of said section depending on the height of the latter, is a curve which is continuous from the root to the tip of the vane and which satisfies at least the following conditions:

the curve is located below a segment connecting a point of said curve which corresponds to the section at the root of the vane and a point of said curve which corresponds to the section at the tip of the vane, the curve is convex between the section height at the root of the vane and a first section height which is strictly greater than the section height at the root of the vane, the curve is concave between the first section height and a second section height which is strictly greater than the first section height, the curve is convex between the second section height and a third section height, which is strictly greater than the second section height, the curve is concave between the third section height and a fourth section height, which is strictly greater than the third section height, and the curve is convex between the fourth section height and the section height at the tip of the vane, said fourth height being strictly smaller than the section height at the tip of the vane.

2. The vane according to claim 1, wherein: the curve of the stacking law of the sections of the vane:

is decreasing between the second section height and a fifth section height and increasing between the fifth section height and the third section height, said fifth section height being strictly greater than the second section height and strictly smaller than the third section height, and/or the curve is decreasing between the section height at the root of the vane and a sixth section height and increasing between the sixth section height and the first section height, said sixth section height being strictly greater than the section height at the root of the vane and strictly smaller than the first section height, and/or the curve is increasing between the first section height and a seventh section height and decreasing between the seventh section height and the second section height, said seventh section height being strictly greater than the first section height and strictly smaller than the second section height, and/or the curve is increasing between the third section height and an eighth section height and decreasing between the eighth section height and the fourth section height, said eighth section height being strictly greater than the third section height and strictly smaller than the fourth section height, and/or the curve is decreasing between the fourth section height and a ninth section height and increasing between the ninth section height and the section height at the tip of the vane, said ninth section height being strictly greater than the fourth section height and strictly smaller than the section height at the tip of the vane.

3. The vane according to claim 2, wherein the points of the curve corresponding to the fifth, sixth, seventh, eighth and ninth heights respectively form a third, a first, a second, a fourth and a fifth apex of said curve, and wherein a shift along the tangential direction of each of the apices of the curve relatively to a segment connecting, for each apex, the point of the curve positioned at half-distance between said apex and the preceding apex or when this is the first apex, at half-distance between said first apex and the point of the curve corresponding to the section at the root of the vane, and the point of the curve positioned at half-distance between said apex and the next apex or when this is the fifth apex, at half-distance between said fifth apex and the point of the curve corresponding to the section at the tip of the vane, is substantially equal to 10% of the height at the tip of the vane.

4. The vane according to claim 1, wherein the curve representative of the stacking law of the sections of the vane is decreasing between the section height at the root of the vane and a fifth section height and increasing between the fifth section height and the section height at the tip of the vane, said fifth section height being strictly greater than the second section height and strictly smaller than the third section height.

5. The vane according to claim 1, wherein the tangential coordinate of the center of gravity is minimum for a fifth section height, said fifth section height being strictly greater than the second section height and strictly smaller than the third section height.

6. The vane according to claim 2, wherein the fifth section height substantially corresponds to half the height of the vane.

7. The vane according to claim 1, wherein the first, second, third and fourth section heights are distributed along the vane between the section height at the root of the vane and the section height at the tip of the vane so as to form successive vane segments of substantially equal height.

8. A guide vane of a turbine engine comprising at least one vane according to claim 1.

9. A turbine engine comprising at least one guide vane according to claim 8.

* * * * *